United States Patent [19]

Kertzman

[11] Patent Number: 4,773,158

[45] Date of Patent: Sep. 27, 1988

[54] WALL MOUNTABLE SAFETY RAZOR HOLDER

[76] Inventor: Harvey Z. Kertzman, 806 W. Roxbury Pkwy., Brookline, Mass. 02167

[21] Appl. No.: 60,355

[22] Filed: Jun. 10, 1987

[51] Int. Cl.[4] ..... B26B 21/40
[52] U.S. Cl. ..... 30/90; 30/32
[58] Field of Search ..... 30/32, 41, 90; 132/80 R, 80 B

[56] References Cited

U.S. PATENT DOCUMENTS 1,981,674 11/1934 Solomon ..... 30/90 UX
2,636,264 4/1953 Ganzer ..... 30/90

*Primary Examiner*—Douglas D. Watts
*Attorney, Agent, or Firm*—John M. Brandt

[57] ABSTRACT

A wall mountable safety razor holder consisting of a planar member, two razor supports extending outward from the planar member, two razor retaining members extending upward from the support members, and a corrosion inhibiting water repellant strip of material disposed along the support members.

4 Claims, 1 Drawing Sheet

WALL MOUNTABLE SAFETY RAZOR HOLDER

BACKGROUND OF THE INVENTION

1. Field of the Invention:

The invention resides in the field of bathroom appliances and more particularly relates to wall attachable holders for safety razors.

2. Description of the Prior Art:

Safety razors, i. e. the type which are either entirely disposable or have disposable blades, are widely used bathroom implements in today's society. Most of these devices are designed to be used more than once, that is, that they can be used for more than one shaving activity.

If, after use, the razor is placed on a shelf, the water caught in the head may run off to form a puddle which the blade can rest in resulting in the formation of rust. If the razor is placed instead in a blade up position, some danger of cutting is possible. In either case, the razor is easily displaced and if located for example in the vicinity of a shower or bathtub can be inadvertently stepped on or sat upon.

The present invention is designed to prevent both the formation of rust and accidental displacement. To that end, a wall mountable bifurcated holder is provided which has at the position where the blade and holder are in close proximity a strip of corrosion inhibiting water repelling material which will alleviate the tendency toward rust formation.

By employing a piece of self adhesive tape, the holder may be secured at any convenient place within the bathroom and further may be moved and repositioned from time to time as the adhesive quality of the tape allows.

The inventor knows of no other device in the prior art which anticipates or accomplishes the purposes of his invention.

SUMMARY OF THE INVENTION

The invention is summarized as a safety razor holder which may be attached to a wall by self adhesive tape or other means which holder is composed of a planar member, a pair of separated razor supports extending outwardly from the planar member; and a pair of razor retaining members one each extending upward from each support member. The head of the razor rests on the support members, the handle fitting downwardly in between. The razor is prevented from falling away from the holder by the two retaining members.

A strip of corrosion-inhibiting water-repelling material is positioned atop the support members in a manner such that the head portion of the razor containing the blade is in contact with the strip. Depending upon the design of the razor, the blade itself is therefore in close proximity or directly touching the corrosion-resistant water-repellant material.

The attaching means are preferably a section of double backed self adhesive tape one side of which is secured to the planar member and the other to the wall. The holder may thus be placed in any convenient location and depending upon the strength of the adhesive moved from one location to another from time to time.

The advantages and features of the invention will be more fully understood from the following drawings and description of the preferred embodiment.

DESCRIPTION OF THE PREFERRED EMBODIMENT

Figure 2:
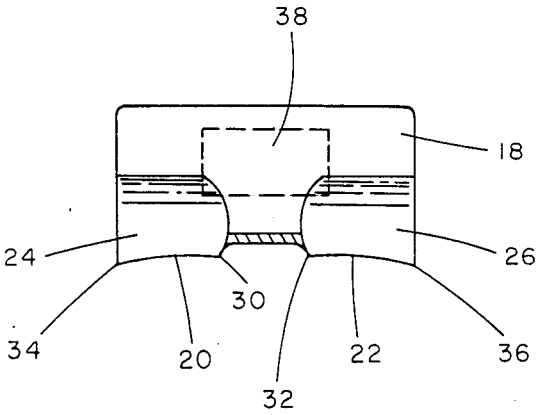
FIG. 2 is a view of the embodiment of FIG. 1.
Figure 4:
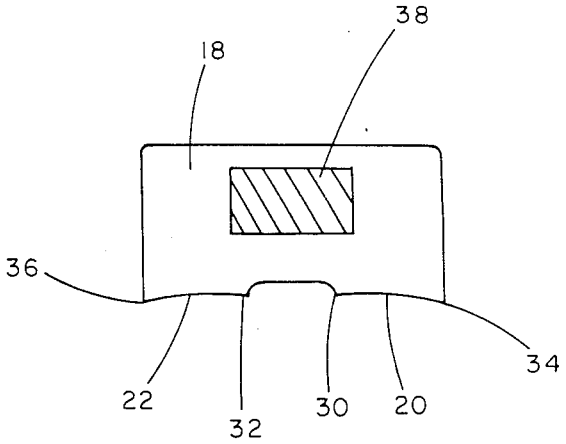
FIG. 4 is a rear view of the embodiment of FIG. 1.
Figure 3:
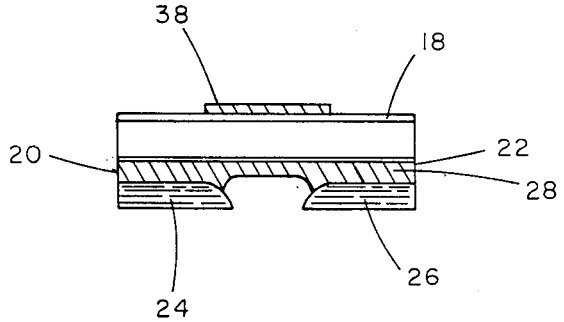
FIG. 3 is a top view of the embodiment of FIG. 1.
Figure 5:
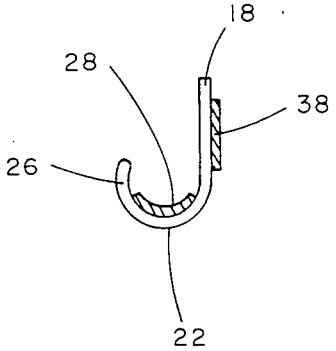
FIG. 5 is a side view of the embodiment of FIG. 1.
Figure 1:
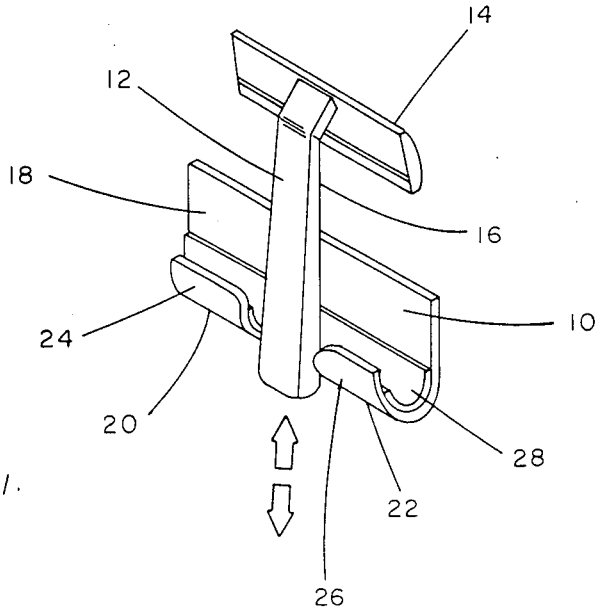
FIG. 1 is a perspective view of the preferred embodiment of the invention.

Referring to the drawings, a plurality of views illustrate the preferred embodiment of the invention. As shown in FIG. 1 holder 10 is arranged to receive and support razor 12 having head 14 and handle 16. The holder consists of a planar back piece 18, two spaced apart razor supports 20 and 22 and two retaining members 24 and 26 extending one each from supports 20 and 22.

A strip of corrosion-inhibiting water-repellant material 28 is secured across the top of each support in such a position that the razor head rests upon the material. The strip may be composed of, for example, silicon impregnated plastic or silicon rubber.

To further augment the removal of water from the vicinity of the head, the supports 20 and 22 may extend or curve downward from the center of edges 30 and 32 to the outer edges 34 and 36 of the supports. Such a configuration will cause the razor to rest upon the center portions of the supports and facilitate the run off of excess water.

The holder may be secured to a wall by any suitable means but preferably by a section of double-backed adhesive tape 38.

The holder has been described as composed of separated structural components. However, it will be understood that these components may be merged into a single configuration such as the J-shaped device illustrated in the figures. Such an arrangement may be easily fabricated by for examples molding in plastic. Other variations will become apparent to those skilled in the art. The invention is therefore defined by the following claims.

What is claimed is:

1. A wall mountable safety razor holder comprising in combination:

a. a wall mountable planar member;

b. a pair of spaced apart razor support members extending outwardly from said planar member each of said support members sloping downwardly from the center of said holder such that the outer edge of each of said members is at a lower elevation than the center edge;

c. a pair of spaced apart razor retaining members extending one each upwardly from each of said support members;

d. attaching means for securing said planar member to a wall; and e. a strip of corrosion-inhibiting water-repelling material positioned atop of and attached to each of said support members.

2. The apparatus of claim 1 wherein said corrosion-inhibiting strip comprises silicon impregnated plastic.

3. The apparatus of claim 1 wherein said corrosion-inhibiting strip comprises silicon impregnated rubber.

4. The apparatus of claim 1 wherein said attaching means comprises a strip of double backed self adhesive tape.

* * * * *